US009949504B2

(12) United States Patent
Emmett et al.

(10) Patent No.: US 9,949,504 B2
(45) Date of Patent: Apr. 24, 2018

(54) SMOKING ARTICLE WITH A VENTILATED MOUTHPIECE COMPRISING FIRST AND SECOND AIRFLOW PATHWAYS

(71) Applicant: PHILIP MORRIS PRODUCTS S.A., Neuchatel (CH)

(72) Inventors: Robert Emmett, Neuchatel (CH); Jerome Uthurry, Neuchatel (CH); Alen Kadiric, Yverdon-les-Baines (CH); Enrique Dalmau, La Chaux-de-Fonds (CH)

(73) Assignee: Philip Morris Products S.A., Neuchatel (CH)

( * ) Notice: Subject to any disclaimer, the term of this patent is extended or adjusted under 35 U.S.C. 154(b) by 1000 days.

(21) Appl. No.: 14/361,360

(22) PCT Filed: Nov. 30, 2012

(86) PCT No.: PCT/EP2012/074057

§ 371 (c)(1),
(2) Date: May 29, 2014

(87) PCT Pub. No.: WO2013/079645

PCT Pub. Date: Jun. 6, 2013

(65) Prior Publication Data

US 2014/0318562 A1 Oct. 30, 2014

(30) Foreign Application Priority Data

Nov. 30, 2011 (EP) ..... 11250914

(51) Int. Cl.
*A24D 3/04* (2006.01)

(52) U.S. Cl.
CPC ..... *A24D 3/041* (2013.01); *A24D 3/043* (2013.01)

(58) Field of Classification Search
None
See application file for complete search history.

(56) References Cited

U.S. PATENT DOCUMENTS 4,532,943 A 8/1985 Nichols
4,570,649 A 2/1986 Nichols
(Continued)

FOREIGN PATENT DOCUMENTS

EA 007110 6/2006
EP 0 158 080 10/1985
(Continued)

OTHER PUBLICATIONS

Third Party Observations for European Application No. 12808278.1 dated Jan. 29, 2016 (20 pages).
(Continued)

*Primary Examiner* — Dennis Cordray
(74) *Attorney, Agent, or Firm* — Mueting, Raasch & Gebhardt, P.A.

(57) ABSTRACT

A smoking article (10, 30, 40, 50, 70) with variable ventilation comprises a mouthpiece (12) circumscribed by a first wrapper (24) and a second wrapper (25). The first wrapper (24) and the second wrapper (25) are substantially air impermeable and are movable relative to one another between a low ventilation configuration and a high ventilation configuration. The mouthpiece (12) comprises a first airflow pathway (18, 19) through the first wrapper (24) or the second wrapper (25) and a second airflow pathway (26) through the first wrapper (24) or the second wrapper (25). In the low ventilation configuration airflow into the mouthpiece (12) through the first airflow pathway (18, 19) is restricted and airflow into the mouthpiece (12) through the second airflow pathway (26) is substantially unrestricted. In the high ventilation configuration airflow into the mouthpiece
(Continued)

Figure 1:
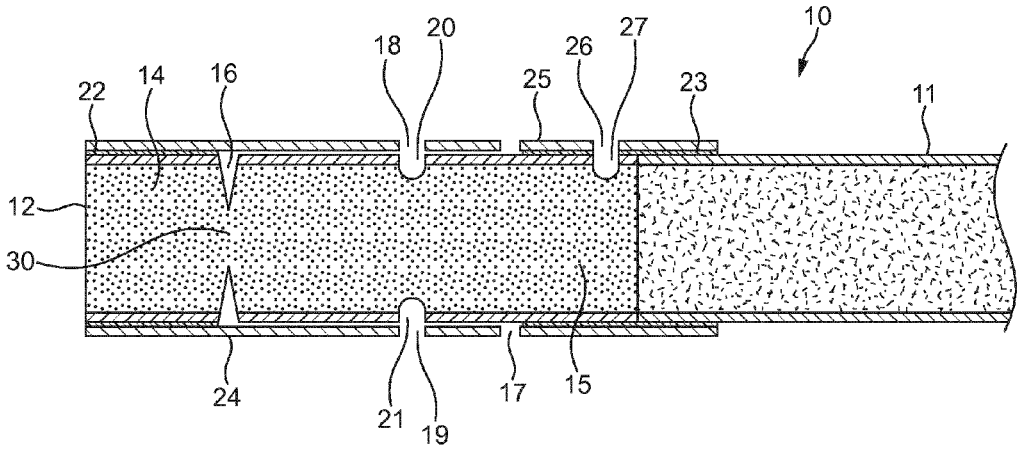

(12) through the first airflow pathway (18, 19) and the second airflow pathway (26) is substantially unrestricted.

17 Claims, 2 Drawing Sheets

(56) References Cited

U.S. PATENT DOCUMENTS

| | | | |
|---|---|---|---|
| 4,600,027 | A | 7/1986 | Houck |
| 4,601,298 | A † | 7/1986 | Nichols |
| 4,638,818 | A | 1/1987 | Nichols |
| 4,646,763 | A | 3/1987 | Nichols |
| 4,648,413 | A | 3/1987 | Saintsing |
| 4,687,009 | A | 8/1987 | Nichols |
| 4,699,158 | A | 10/1987 | Sprinkel |
| 4,700,725 | A | 10/1987 | Geiszler |
| 4,716,912 | A | 6/1988 | Leonard |
| 4,898,190 | A † | 2/1990 | Deal |
| 2004/0200490 | A1 | 10/2004 | Inagaki |

FOREIGN PATENT DOCUMENTS

| | | |
|---|---|---|
| EP | 0158080 A1 † | 10/1985 |
| EP | 0 664 089 | 7/1995 |
| JP | 60-203177 | 10/1985 |
| JP | 61-166387 | 7/1986 |
| JP | 2525821 | 12/2002 |
| JP | 1709169 | 12/2005 |
| RU | 2044508 | 9/1995 |
| RU | 2264767 | 11/2005 |
| WO | WO 2008/121610 | 10/2008 |
| WO | WO 2009/022232 | 2/2009 |
| WO | WO 2010/107613 | 9/2010 |
| WO | WO 2011/119676 | 9/2011 |
| WO | 2011121328 A2 † | 10/2011 |
| WO | WO 2011/121328 | 10/2011 |

OTHER PUBLICATIONS

Office Action issued in Japan for Application No. 2014-543905 dated Oct. 3, 2016 (9 pages). English translation included.
Office Action issued in China for Application No. 201280066618.7 dated Nov. 10, 2016 (18 pages). English translation included.
Notice of Allowance in Russia for Application No. 2014126364 dated Jan. 31, 2017 (13 pages). English translation included.
PCT International Search Report for International Application No. PCT/EP2012/074057 dated Mar. 18, 2013 (4 pages).
Office Action issued in Australia for Application No. 20122343801 dated Jun. 20, 2016 (3 pages).

† cited by third party

SMOKING ARTICLE WITH A VENTILATED MOUTHPIECE COMPRISING FIRST AND SECOND AIRFLOW PATHWAYS

This application is a U.S. National Stage Application of International Application No. PCT/EP2012/074057, filed Nov. 30, 2012, which was published in English on Jun. 6, 2013, International Patent Publication WO 2013/079645 A1. International Application No. PCT/EP2012/074057 claims priority to European Application No. 11250914.6 filed Nov. 30, 2011.

The present invention relates to a smoking article with variable ventilation. In particular, the present invention relates to a smoking article comprising a mouthpiece that is adjustable to vary the level of ventilation.

Filter cigarettes and other types of combustible smoking articles in which tobacco cut filler or other smokable material is combusted to form smoke are known. Filter cigarettes typically comprise a rod of tobacco cut filler circumscribed by a paper wrapper and a cylindrical filter aligned in end-to-end relationship with the wrapped tobacco rod. The filter is generally attached to the wrapped tobacco rod by tipping paper, which circumscribes the filter and an adjacent portion of the wrapper tobacco rod.

Non-combustible smoking articles in which a tobacco material or other aerosol-generating substrate is heated rather than combusted are also known. In heated smoking articles, an aerosol is typically generated by the transfer of heat from a heat source, for example a chemical, electrical or combustible heat source, to a physically separate aerosol-generating substrate, which may be located within, around or downstream of the heat source. During smoking, volatile compounds are released from the aerosol generating substrate by heat transfer from the heat source and entrained in air drawn through the smoking article. As the released compounds cool they condense to form an aerosol that is inhaled by the consumer.

Non-combustible smoking articles in which an aerosol, in particular a nicotine-containing aerosol, is generated from a tobacco material, tobacco extract, or other nicotine source or aerosol generating substrate, without combustion or heating are also known.

It is known to provide the filters or mouthpieces of combustible and non-combustible smoking articles with ventilation in order to mix the mainstream smoke produced during use of the smoking articles with ambient air. For example, in filter cigarettes ventilation in the form of one or more circumferential rows of perforations in the band of tipping paper is commonly provided at a location along the filter, to mix the mainstream smoke produced during combustion of the wrapped tobacco rod with ambient air. Filter cigarettes having mechanisms for varying the level of ventilation obtained during smoking, which enable a consumer to vary the ratio of ambient air to mainstream smoke, are also known.

In one type of known mechanism, a band of tipping paper circumscribing the filter is rotatable relative to the remainder of the filter about the longitudinal axis of the filter cigarette in order to vary the level of ventilation obtained during smoking. For example, U.S. Pat. No. 4,570,649 and U.S. Pat. No. 4,638,818 disclose variable dilution filter cigarettes comprising a substantially cylindrical tobacco rod, a substantially cylindrical filter plug, a plug wrap circumscribing the filter plug and a tipping paper circumscribing the plug wrap and a portion of the tobacco rod, wherein at least one of the plug wrap and the tipping paper is air impermeable. The plug wrap is divided into a mouth-end band, a central band and a rod-end band having a first opening therein. The mouth-end and rod-end bands are fixed to the filter, while the central band is rotatable about the longitudinal axis of the filter plug. The tipping paper is divided into a first band and a second band. The first band of the tipping paper extends from the mouth end of the filter plug to a position overlying the rod-end band of the plug wrap and is attached only to the central band of the plug wrap for rotation therewith about the longitudinal axis of the filter plug. The first band of the tipping paper has a second opening therein overlying the rod-end band of the plug wrap such that rotation of the first band rotates the second opening into varying degrees of registry with the first opening in the rod-end band thereby varying the level of dilution obtained during smoking. The second band of the tipping paper extends from the first band to a position on the tobacco rod and joins the tobacco rod to the filter plug.

In another type of known mechanism, a segment of the filter is rotatable relative to the remainder of the filter about the longitudinal axis of the filter cigarette in order to vary the level of ventilation obtained during smoking. For example, U.S. Pat. No. 4,700,725 disclose variable dilution filter cigarettes comprising a tobacco rod, a substantially cylindrical filter plug, plug wrapping circumscribing the filter plug, and tipping paper circumscribing and joining the filter plug and a portion of the tobacco rod, wherein at least one of the plug wrapping and the tipping paper is substantially air-impermeable. The filter plug comprises a mouth-end segment axially connected to a rod-end segment for rotation about the axis of the cigarette. The tipping paper has a first opening therein and the plug wrapping has a second opening therein underlying the first opening. The openings overlie one of the mouth-end and rod-end segments of the filter plug, such that rotation of the mouth-end segment relative to the rod-end segment varies the registry between the first and second openings for varying the air dilution value of the filter cigarette. The filter cigarette further comprises stop means for restricting the relative rotation of the segments to a desired rotational range. U.S. Pat. No. 4,532,943 and U.S. Pat. No. 4,699,158 disclose adjustable filter cigarettes with similar mechanisms to adjust the air dilution value of the cigarette.

In a further type of known mechanism, the filter is movable toward and away from the tobacco rod along the longitudinal axis of the filter cigarette in order to vary the level of ventilation obtained during smoking. For example, U.S. Pat. No. 4,716,912 discloses a filter cigarette having adjustable air dilution comprising a rod of smokable material, an axially aligned filter plug, and tipping material circumscribing and fixedly attached to the filter plug and circumscribing a portion of the rod in the region adjacent the filter plug. The cigarette further comprises first and second bands in an end-to-end relationship, which circumscribe the rod in the region adjacent the filter plug and which are disposed in and substantially fill the transverse region between the outer surface of the rod and the inner surface of the tipping material. The first band is fixedly attached to the rod in the region adjacent the filter plug. The second band is positioned adjacent the first band towards the lit end of the cigarette and the outer surface thereof is fixedly attached to the inner surface of the tipping material which overlies the band. The tipping material comprises an air permeable region in the region therein which overlies an air impermeable region of the first band when the filter plug is positioned as to substantially abut the rod. The first and second bands are positioned in a spaced apart relationship when the filter plug is positioned so as to substantially abut the rod.

Movement of the filter plug away from the rod along the longitudinal axis of the cigarette in order that the filter plug does not abut the rod provides exposure of the airspace formed between the filter plug and the rod through the air permeable region of the tipping material and thereby provides air dilution capabilities to the cigarette.

Filter cigarettes with other mechanisms for varying the level of ventilation obtained during smoking are also known. For example, U.S. Pat. No. 4,600,027, U.S. Pat. No. 4,687,009, U.S. Pat. No. 4,898,190 and WO 2011/121328 A2 also disclose cigarettes with mechanisms to adjust the air dilution value of the cigarette.

The known mechanisms for varying the level of ventilation obtained during smoking disclosed in the prior art documents described above are all movable to or through a 'fully closed' or 'off' position.

In some cases the known mechanisms are movable between a fully closed position and an open position. In other cases the known mechanisms are movable between a partially closed position and an open position via a fully closed position.

In smoking articles comprising known mechanisms of the types described above, the level of ventilation obtained when the mechanism is in the fully closed position tends to vary from smoking article to smoking article. This can disadvantageously lead to undesirably high levels of waste during manufacture of such smoking articles due to the need to reject smoking articles having a level of ventilation in the fully closed position that falls outside of an acceptable range.

It would be desirable to provide smoking articles with variable ventilation wherein the level of ventilation is consistent from smoking article to smoking article. In particular, it would be desirable to provide smoking articles with variable ventilation having a consistent level of ventilation in the lowest ventilation position.

It would also be desirable to provide smoking articles with variable ventilation that can be manufactured with reduced levels of waste.

According to the present invention there is provided a smoking article comprising a mouthpiece circumscribed by a first wrapper and a second wrapper. The first wrapper and the second wrapper are substantially air impermeable and are movable relative to one another between a low ventilation configuration and a high ventilation configuration. The mouthpiece comprises a first airflow pathway through the first wrapper or the second wrapper and a second airflow pathway through the first wrapper or the second wrapper. In the low ventilation configuration airflow into the mouthpiece through the first airflow pathway is restricted and airflow into the mouthpiece through the second airflow pathway is substantially unrestricted. In the high ventilation configuration airflow into the mouthpiece through the first airflow pathway and the second airflow pathway is substantially unrestricted.

Smoking articles according to the invention may be in the form of filter cigarettes or other smoking articles in which tobacco cut filler or other smokable material is combusted. The invention additionally encompasses smoking articles in which tobacco material or another aerosol-generating substrate is heated rather than combusted and smoking articles in which an aerosol, in particular a nicotine-containing aerosol, is generated from a tobacco material, tobacco extract, or alternative nicotine source or another aerosol generating substrate, without combustion or heating.

In the following description, the term "mainstream smoke" is used to describe mainstream smoke and aerosols produced by combustible smoking articles, such as filter cigarettes, and non-combustible smoking articles, such as heated or non-heated smoking articles of the types described above.

As used herein, the term "substantially air impermeable" is used to describe wrappers having an air permeability of less than about 100 Coresta units as measured in accordance with ISO 2965:2009.

As used herein, the terms "high ventilation" and "low ventilation" are used to describe the level of air admitted to the mouthpiece of the smoking article during smoking and the resultant air dilution of the mainstream smoke obtained. The greater the level of ventilation, the greater the level of air admitted to the mouthpiece of the smoking article during smoking and the greater the resultant air dilution of the mainstream smoke.

As used herein, the term "airflow pathway" is used to describe one or more holes, slits, slots or other apertures through the first wrapper or the second wrapper.

As used herein, the term "restricted" is used to indicate that the first airflow pathway is partially or completely obstructed such that airflow into the mouthpiece through the first airflow pathway is impeded or prevented.

Substantially unrestricted airflow through the first airflow pathway and the second airflow pathway in the high ventilation configuration, allows a relatively high level of ventilation. Restricted airflow through the first airflow pathway and substantially unrestricted airflow through the second airflow pathway in the low ventilation configuration, allows a relatively low level of ventilation.

The first wrapper and the second wrapper of smoking articles according to the invention are not movable relative to one another to or through a configuration in which the first airflow pathway and the second airflow pathway are completely obstructed such that airflow into the mouthpiece through the first airflow pathway and the second airflow pathway is prevented. In other words, in contrast to the known mechanisms described above, the first wrapper and the second wrapper of smoking articles according to the invention are not movable relative to one another to or through a 'fully closed' position.

Instead, at least a minimum or 'baseline' level of ventilation is provided by airflow into the mouthpiece of smoking articles according to the invention through one or both of the first airflow pathway and the second airflow pathway during movement of the first wrapper and the second wrapper relative to one another between the low ventilation configuration and the high ventilation configuration.

The level of ventilation provided in the high ventilation configuration is the maximum level of ventilation.

Preferably, the level of ventilation provided in the low ventilation configuration is the minimum or 'baseline' level of ventilation. That is, the level of ventilation provided by airflow into the mouthpiece of smoking articles according to the invention through the first airflow pathway and the second airflow pathway during movement of the first wrapper and the second wrapper relative to one another between the low ventilation configuration and the high ventilation configuration is preferably greater than or equal to the level of ventilation provided by airflow through the first airflow pathway and the second airflow pathway in the low ventilation configuration, In use, airflow into the mouthpiece through the second airflow pathway in the low ventilation configuration reduces the pressure drop across the variable ventilation mechanism of smoking articles according to the invention. This reduces the tendency for airflow into the mouthpiece other than through the second airflow pathway and so advantageously results in a more consistent baseline level of ventilation in the low ventilation configuration from smoking article to smoking article.

Provision of a more consistent baseline level of ventilation from smoking article to smoking article advantageously reduces waste during manufacture of smoking articles according to the invention.

In the low ventilation configuration airflow into the mouthpiece of smoking articles according to the invention through the first airflow pathway provides a first level of ventilation and in the high ventilation configuration airflow into the mouthpiece of smoking articles according to the invention through the first airflow pathway provides a second level of ventilation, wherein the second level of ventilation is greater than the first level of ventilation. The first level of ventilation provided by airflow into the mouthpiece through the first airflow pathway in the low ventilation configuration may be substantially zero.

In the low ventilation configuration airflow into the mouthpiece of smoking articles according to the invention through the second airflow pathway provides a third level of ventilation and in the high ventilation configuration airflow into the mouthpiece of smoking articles according to the invention through the second airflow pathway provides a fourth level of ventilation. The third level of ventilation and the fourth level of ventilation may be the same or different. Preferably, the third level of ventilation and the fourth level of ventilation are substantially the same.

Preferably, in smoking articles with variable ventilation according to the invention the first wrapper and the second wrapper are movable relative to one another between a low ventilation configuration, in which ventilation is provided by airflow through the second airflow pathway, and a high ventilation configuration, in which ventilation is provided by airflow though both the first airflow pathway and the second airflow pathway. Movement of the first wrapper and the second wrapper relative to one another between the low ventilation configuration and the high ventilation configuration thereby varies the level of ventilation between a minimum or 'baseline' level and a maximum level.

In use, by moving the first wrapper and the second wrapper of combustible smoking articles according to the invention relative to one another, a consumer can alter the level of ventilation and hence the total nicotine free dry particulate matter (NFDPM) or "tar" delivery provided during smoking. In particular, by moving the first wrapper and the second wrapper of smoking articles according to the invention relative to one another from the low configuration to the high configuration, a consumer can increase the level of ventilation and thereby decrease the tar delivery provided during smoking.

The first wrapper and the second wrapper of smoking articles according to the invention are movable relative to one another from the low ventilation configuration to the high ventilation configuration. The first wrapper and the second wrapper of smoking articles according to the invention are also movable relative to one another from the high ventilation configuration to the low ventilation configuration. By moving the first wrapper and the second wrapper of combustible smoking articles according to the invention relative to one another from the high configuration to the low configuration, a consumer can decrease the level of ventilation and thereby increase the tar delivery provided during smoking.

The level of ventilation of smoking articles according to the invention may be altered by a consumer prior to smoking. Alternatively or in addition, the level of ventilation of smoking articles according to the invention may be varied by a consumer during smoking.

The first airflow pathway may be provided through the first wrapper and the second airflow pathway may be provided through the second wrapper.

Alternatively, the first airflow pathway and the second airflow pathway may both be provided through the first wrapper.

The second airflow pathway may be located upstream or downstream of the first airflow pathway. As used herein, the terms "upstream" and "downstream" are used to describe the relative position of portions or components of smoking articles according to the invention in relation to the direction of mainstream smoke drawn through the smoking articles during use thereof.

Alternatively, where the first airflow pathway and the second airflow pathway are both provided through the first wrapper, the first airflow pathway and the second airflow pathway may be circumferentially aligned. As used herein, the term "circumferentially aligned" is used to indicate that the first airflow pathway and the second airflow pathway are substantially aligned around the circumference of the mouthpiece. That is, the position of the first airflow pathway and the second airflow pathway along the longitudinal axis of the smoking article is substantially the same.

The first airflow pathway may comprise a single hole, slit, slot or other aperture through the first wrapper or the second wrapper. Alternatively, the first airflow pathway may comprise two or more holes, slits, slots or other apertures through the first wrapper or the second wrapper. For example, the first airflow pathway may comprise a plurality of circumferentially aligned holes, slits, slots or other apertures through the first wrapper or the second wrapper.

The second airflow pathway may comprise a single hole, slit, slot or other aperture through the first wrapper or the second wrapper. Alternatively, the second airflow pathway may comprise two or more holes, slits, slots or other apertures through the first wrapper or the second wrapper. For example, the second airflow pathway may comprise a plurality of circumferentially aligned holes, slits, slots or other apertures through the first wrapper or the second wrapper.

The first airflow pathway and the second airflow pathway may comprise the same or different numbers of apertures through the first wrapper or the second wrapper.

The first wrapper and the second wrapper may be rotatable relative to one another about the longitudinal axis of the smoking article between the low ventilation configuration and the high ventilation configuration.

Alternatively, the first wrapper and the second wrapper may be movable along the longitudinal axis of the smoking article relative to one another between the low ventilation configuration and the high ventilation configuration.

Where the first wrapper and the second wrapper are movable along the longitudinal axis of the smoking article relative to one another between the low ventilation configuration and the high ventilation configuration, the length of the smoking article in the high ventilation configuration may be greater than the length of the smoking article in the low ventilation configuration. Alternatively, the length of the smoking article in the high ventilation configuration may be shorter than the length of the smoking article in the low ventilation configuration.

As used herein, the term "length" denotes the dimension in the direction of the longitudinal axis of smoking articles according to the invention.

The first wrapper and the second wrapper may abut one another in one or both of the low ventilation configuration and the high ventilation configuration. For example, where the first wrapper and the second wrapper are rotatable relative to one another about the longitudinal axis of the smoking article between the low ventilation configuration and the high ventilation configuration, the first wrapper and the second wrapper may abut one another in the low ventilation configuration and the high ventilation configuration.

Alternatively, the first wrapper and the second wrapper may be longitudinally spaced apart from one another in one or both of the low ventilation configuration and the high ventilation configuration. For example, where the first wrapper and the second wrapper are movable along the longitudinal axis of the smoking article relative to one another between the low ventilation configuration and the high ventilation configuration, the first wrapper and the second wrapper may abut one another in the low ventilation configuration and be longitudinally spaced apart from one another in the high ventilation configuration.

Alternatively, the second wrapper may at least partially overlie or underlie the first wrapper in one or both of the low ventilation configuration and the high ventilation configuration.

In certain embodiments, the mouthpiece of smoking articles according to the invention may further comprise a third airflow pathway, wherein in the low ventilation configuration the first airflow pathway and the third airflow pathway are substantially misaligned and airflow into the mouthpiece through the first airflow pathway is restricted and wherein in the high ventilation configuration the first airflow pathway and the third airflow pathway are substantially aligned and airflow into the mouthpiece through the first airflow pathway is substantially unrestricted. The third airflow pathway may be provided through a substantially air impermeable inner wrapper underlying the first wrapper or the second wrapper through which the first airflow pathway is provided.

In use, movement of the first wrapper and the second wrapper relative to one another between the low ventilation configuration and the high ventilation configuration allows the degree of registry between the first airflow pathway and the third airflow pathway to be varied.

In such embodiments, the mouthpiece may also further comprise a fourth airflow pathway, wherein in the low ventilation configuration and the high ventilation configuration the second airflow pathway and the fourth airflow pathway are substantially aligned and airflow into the mouthpiece through the second airflow pathway is substantially unrestricted.

Alternatively, the mouthpiece may further comprise a fourth airflow pathway, wherein in the low ventilation configuration the second airflow pathway and the fourth airflow pathway are substantially aligned and airflow into the mouthpiece through the second airflow pathway is substantially unrestricted and wherein in the high ventilation configuration the second airflow pathway and the third airflow pathway are substantially aligned and airflow into the mouthpiece through the second airflow pathway is substantially unrestricted. In one such embodiment of the invention, the first wrapper and the second wrapper are rotatable along the longitudinal axis of the smoking article relative to one another between the low ventilation configuration and the high ventilation configuration and the first airflow pathway and the second airflow pathway are both provided through the first wrapper and are circumferentially aligned.

The fourth airflow pathway may be provided through a substantially air impermeable inner wrapper underlying the first wrapper or the second wrapper through which the second airflow pathway is provided.

Where the mouthpiece comprises a third airflow pathway and a fourth airflow pathway, the third airflow pathway and the fourth airflow pathway may be provided through a single substantially air impermeable inner wrapper. Alternatively, the third airflow pathway may be provided through a first substantially air impermeable inner wrapper and the fourth airflow pathway may be provided through a second substantially air impermeable inner wrapper.

In other embodiments, in the low ventilation configuration the first airflow pathway is covered and airflow into the mouthpiece through the first airflow pathway is restricted and in the high ventilation configuration the first airflow pathway is uncovered and airflow into the mouthpiece through the first airflow pathway is substantially unrestricted. In use, movement of the first wrapper and the second wrapper relative to one another between the low ventilation configuration and the high ventilation configuration allows the degree of exposure of the first airflow pathway to be varied.

In such embodiments, the mouthpiece may further comprise a third airflow pathway through a substantially air impermeable inner wrapper underlying the first wrapper or the second wrapper through which the first airflow pathway is provided, wherein in the low ventilation configuration and the high ventilation configuration the first airflow pathway and the third airflow pathway are substantially aligned.

Alternatively or in addition, the mouthpiece may further comprise a fourth airflow pathway through a substantially air impermeable inner wrapper underlying the first wrapper or the second wrapper through which the second airflow pathway is provided, wherein in the low ventilation configuration and the high ventilation configuration the second airflow pathway and the fourth airflow pathway are substantially aligned.

In one embodiment of the invention, the first wrapper and the second wrapper are movable along the longitudinal axis of the smoking article relative to one another between the low ventilation configuration and the high ventilation configuration and the first airflow pathway is provided through the first wrapper. In the low ventilation configuration the second wrapper overlies the first airflow pathway and airflow into the mouthpiece through the first airflow pathway is restricted and wherein in the high ventilation configuration the second wrapper does not overlie the first airflow pathway and airflow into the mouthpiece through the first airflow pathway is substantially unrestricted.

Where the mouthpiece comprises a third airflow pathway and a fourth airflow pathway, the third airflow pathway and the fourth airflow pathway may be provided through a single substantially air impermeable inner wrapper. Alternatively, the third airflow pathway may be provided through a first substantially air impermeable inner wrapper and the fourth airflow pathway may be provided through a second substantially air impermeable inner wrapper.

The first wrapper and the second wrapper may be from the same or different materials. Suitable materials from which the first wrapper and the second wrapper may be made are known in the art and include, but are not limited to, substantially air impermeable papers and substantially air impermeable polymeric films. Preferably, the first wrapper and the second wrapper are made of substantially air impermeable tipping paper.

The air permeability of the first wrapper and the second wrapper may be the same or different. Preferably the first wrapper and the second wrapper have an air permeability of less than about 100 Coresta units, more preferably of less than about 50 Coresta units, and most preferably of less than about 10 Coresta units as measured in accordance with ISO 2965:2009.

The air permeability in Coresta units is the amount of air in cubic centimeters that passes through one square centimeter of the wrapper in one minute at a constant pressure difference of one kilopascal (that is, 1 Coresta unit corresponds to an air permeability of 1 $cm^3/min \cdot cm^2$ at a pressure differential of 1 kPa).

Where smoking articles according to the invention comprise a mouthpiece comprising a third airflow pathway through a substantially air impermeable inner wrapper, the substantially air impermeable inner wrapper may be formed from suitable materials known in the art including, but not limited to, substantially air impermeable papers and substantially air impermeable polymeric films. Preferably, the substantially air impermeable inner wrapper is made of substantially air impermeable filter plug wrap.

Where mouthpieces of smoking articles according to the invention comprise a fourth airflow pathway through a substantially air impermeable inner wrapper, the substantially air impermeable inner wrapper may be formed from suitable materials known in the art including, but not limited to, substantially air impermeable papers and substantially air impermeable polymeric films. Preferably, the substantially air impermeable inner wrapper is made of substantially air impermeable filter plug wrap.

Where smoking articles according to the invention comprise a mouthpiece comprising a third airflow pathway through a first substantially air impermeable wrapper and a fourth airflow pathway through a second substantially air impermeable inner wrapper, the first substantially air impermeable wrapper and the second substantially air impermeable inner wrapper may be formed of the same or different materials.

Smoking articles according to the invention having different minimum levels of ventilation in the low ventilation configuration may be produced by altering one or both of the number and size of the one or more apertures through the first wrapper or the second wrapper forming the second airflow pathway.

To measure the level of ventilation in the low ventilation configuration, the first wrapper and the second wrapper are moved relative to one another to the low ventilation configuration and the level of ventilation in the low ventilation configuration is then measured in accordance with ISO 9512:2002.

The level of ventilation in the low ventilation configuration is preferably at least about 10%, more preferably at least about 20% as measured in accordance with ISO 9512:2002.

The level of ventilation in the low ventilation configuration is preferably less than about 60%, more preferably less than about 50% as measured in accordance with ISO 9512:2002.

The level of ventilation in the low ventilation configuration is preferably between about 10% and about 60%, more preferably between about 20% and about 50% as measured in accordance with ISO 9512:2002.

Smoking articles according to the invention having different maximum levels of ventilation in the high ventilation configuration may be produced by altering one or both of the number and size of one or more the apertures through the first wrapper or the second wrapper forming the first airflow pathway.

To measure the level of ventilation in the high ventilation configuration, the first wrapper and the second wrapper are moved relative to one another to the high ventilation configuration and the level of ventilation in the high ventilation configuration is then measured in accordance with ISO 9512:2002.

The level of ventilation in the high ventilation configuration is preferably at least about 50%, more preferably at least about 60% as measured in accordance with ISO 9512:2002.

The level of ventilation in the high ventilation configuration is preferably less than about 90%, more preferably less than about 80% as measured in accordance with ISO 9512:2002.

The level of ventilation in the high ventilation configuration is preferably between about 50% and about 90%, more preferably between about 60% and about 80% as measured in accordance with ISO 9512:2002.

The difference between the level of ventilation in the high ventilation configuration and the level of ventilation in the low ventilation configuration is preferably at least about 15%, more preferably at least about 30%. For example, the level of ventilation in the high ventilation configuration may be about 50% and the level of ventilation in the low ventilation configuration may be about 35%, so that the difference between the level of ventilation in the high ventilation configuration and the level of ventilation in the low ventilation configuration is about 15% (that is about 50% minus about 35%).

The percentage of ventilation $V_1$ provided by airflow through the second airflow pathway is preferably at least about 15%, more preferably at least about 25%, most preferably at least about 35%, wherein:

$$V_1 = \frac{\text{level of ventilation in the low ventilation configuration}}{\text{level of ventilation in the high ventilation configuration}} \times 100$$

Smoking articles according to the invention may comprise first airflow pathways and second airflow pathways located at different positions along the longitudinal axis of the mouthpieces thereof depending upon the length of the mouthpieces.

Preferably, the first airflow pathway is located at least about 12 mm from the downstream end of the mouthpiece in the high ventilation configuration. More preferably, the first airflow pathway is located at least about 15 mm from the downstream end of the mouthpiece in the high ventilation configuration.

Preferably, the first airflow pathway is located less than about 50 mm from the downstream end of the mouthpiece in the low ventilation configuration and the high ventilation configuration.

Preferably, the second airflow pathway is located at least 12 mm from the downstream end of the mouthpiece in the low ventilation configuration and the high ventilation configuration. More preferably, the second airflow pathway is located at least 15 mm from the downstream end of the mouthpiece in the low ventilation configuration and the high ventilation configuration.

Preferably, the second airflow pathway is located less than about 50 mm from the downstream end of the mouthpiece in the low ventilation configuration and the high ventilation configuration.

Smoking articles according to the invention may comprise mouthpieces having high, medium or low filtration efficiency.

Smoking articles according to the invention may comprise single segment mouthpieces.

Alternatively, smoking articles according to the invention may comprise multi-segment mouthpieces comprising two or more segments.

In certain embodiments, smoking articles according to the invention may comprise a multi-segment mouthpiece comprising a first segment and a second segment wherein the first segment and the second segment are movable relative to one another between a first position and a second position. In such embodiments, the first wrapper may be affixed to the first segment and the second wrapper may be affixed to the second segment such that the first wrapper and the second wrapper are movable relative to one another between the low configuration and the high configuration upon movement of the first segment and the second segment relative to one another between the first position and the second position.

Smoking articles according to the invention may comprise mouthpieces including one or more segments of cellulose acetate tow, paper or other fibrous or non-fibrous filtration material.

Alternatively or in addition, smoking articles according to the invention may comprise mouthpieces including one or more segments comprising a hollow tube forming a cavity in the mouthpiece, for example a mouth end cavity.

Smoking articles according to the invention may comprise mouthpieces including one or more segments comprising sorbents (for example, activated carbon or silica gel), plant material (for example, tobacco lamina), flavourants, other smoke modifying agents and combinations thereof.

Smoking articles according to the invention may comprise mouthpieces having an external diameter of, for example, between about 5 mm and about 8.5 mm.

Smoking articles according to the invention may comprise mouthpieces having a length of, for example, between about 20 mm and about 50 mm. In embodiments where the length of the mouthpiece in the high ventilation configuration is different to the length of the mouthpiece in the low ventilation configuration, these exemplary lengths refer to the length of the mouthpiece in its longest configuration.

Smoking articles according to the invention may comprise stop means for restricting movement of the first wrapper and the second wrapper relative to one another. For example, where the first wrapper and the second wrapper are rotatable relative to one another about the longitudinal axis of the smoking article between the low ventilation configuration and the high ventilation configuration, smoking articles according to the invention may further comprise stop means of the type described in U.S. Pat. No. 4,700,725 for restricting the relative rotation of the first wrapper and the second wrapper to a desired rotational range.

Smoking articles according to the invention may comprise indication means for indicating the level of ventilation. The indication means may provide one or both of a visual indication and a tactile indication of the level of ventilation to a consumer. For example, where the first wrapper and the second wrapper are rotatable relative to one another about the longitudinal axis of the smoking article between the low ventilation configuration and the high ventilation configuration, smoking articles according to the invention may further comprise indication means of the type described in U.S. Pat. No. 4,699,158 or WO-A1-2011/119676 for indicating the level of ventilation to a consumer.

Smoking articles according to the invention may further comprise a wrapped rod of smokable material connected to the mouthpiece.

A wide variety of different types of smoking articles according to the invention may be produced. For example, smoking articles according to the invention may be combustible smoking articles, such as filter cigarettes, comprising a wrapped rod of tobacco cut filler or other smokable material, which is combusted during smoking. In such embodiments, the wrapped rod of smokable material may be joined to the mouthpiece by the first wrapper or the second wrapper.

Alternatively, smoking articles according to the invention may be non-combustible, heated smoking articles of the type described above in which material is heated to form an aerosol. For example, smoking articles according to the invention may be heated smoking articles comprising a combustible heat source and an aerosol-generating substrate downstream of the combustible heat source, such as those disclosed in WO-A-2009/022232. Smoking articles according to the invention may also be heated smoking articles comprising non-combustible heat sources, for example chemical heat sources or electrical heat sources.

Alternatively, smoking articles according to the invention may be non combustible, non-heated smoking articles of the type described above in which an aerosol is generated from an aerosol generating substrate without combustion or heating, such as those described in WO-A-2008/121610 and WO-A-2010/107613.

Smoking articles according to the invention may have an overall length of, for example, between about 60 mm and about 128 mm. In embodiments where the length of the smoking article in the high ventilation configuration is different to the length of the smoking article in the low ventilation configuration, these exemplary lengths refer to the length of the smoking article in its longest configuration.

Smoking articles according to the invention may have an external diameter of, for example, between about 5 mm and about 8.5 mm, for example between about 5 mm and about 7.1 mm for slim sized combustible smoking articles or between about 7.1 mm and about 8.5 mm for regular sized combustible smoking articles.

Smoking articles according to the invention may be manufactured using methods and machinery for producing known smoking articles with variable air dilution mechanisms. For example, smoking articles according to the invention in which the first wrapper and the second wrapper are rotatable relative to one another about the longitudinal axis of the smoking article between the low ventilation configuration and the high ventilation configuration may be manufactured using the methods and machinery disclosed in U.S. Pat. No. 4,570,649, U.S. Pat. No. 4,638,818, U.S. Pat. No. 4,699,158 and U.S. Pat. No. 4,700,725.

The first airflow pathway through the first wrapper or the second wrapper of the mouthpiece and the second airflow pathway through the first wrapper or the second wrapper of the mouthpiece of smoking articles according to the invention may be formed using suitable known means for providing the filters or mouthpieces of combustible smoking articles and non-combustible smoking articles with ventilation. For example, the first airflow pathway and the second airflow pathway may be formed using laser perforation means or using mechanical perforation means, such as pin perforation means.

Figure 2A:
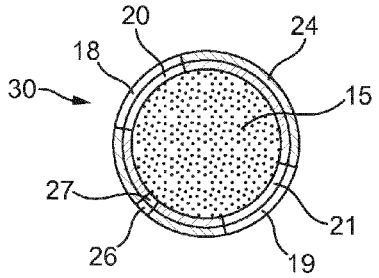
Figure 2B:
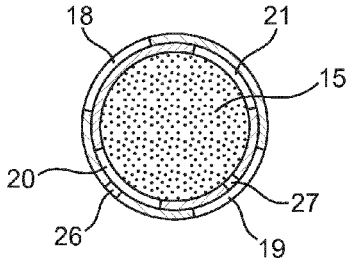
Figure 3A:
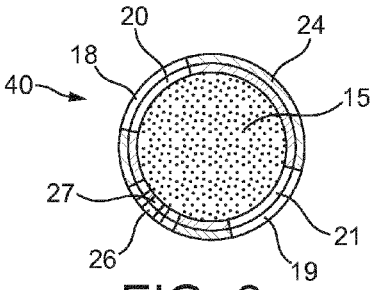
Figure 3B:
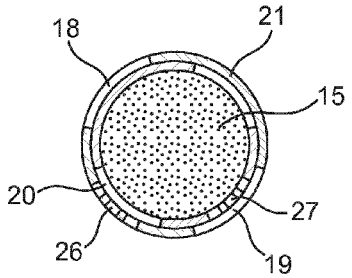
Figure 4:
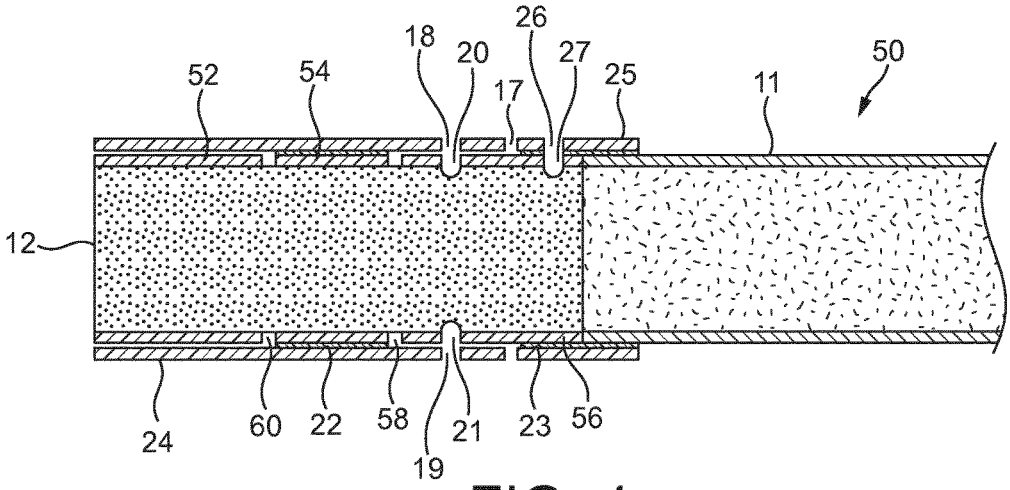
Figure 5:
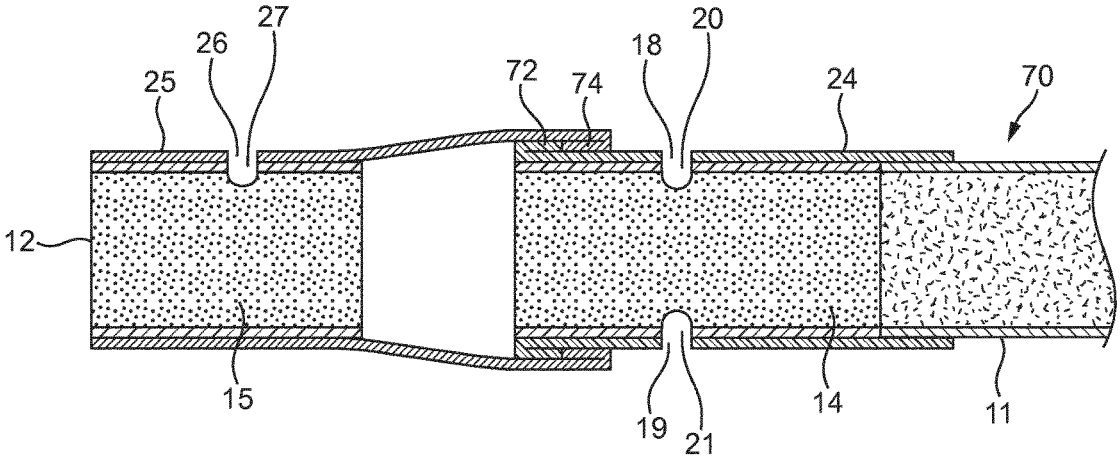

The invention will be further described, by way of example only, with reference to the accompanying drawings, in which:

FIG. 1 shows a schematic longitudinal cross-section of a smoking article according to a first embodiment of the invention in the high ventilation configuration;

FIG. 2*a* shows a schematic transverse cross-section of a smoking article according to a third embodiment of the invention in the high ventilation configuration;

FIG. 2*b* shows a schematic transverse cross-section of the smoking article according to the third embodiment of the invention shown in FIG. 2*a* in the low ventilation configuration; and FIG. 3*a* shows a schematic transverse cross-section of a smoking article according to a fourth embodiment of the invention in the high ventilation configuration;

FIG. 3*b* shows a schematic transverse cross-section of the smoking article according to the fourth embodiment of the invention shown in FIG. 3*a* in the low ventilation configuration;

FIG. 4 shows a schematic longitudinal cross-section of a smoking article according to a fifth embodiment of the invention in the high ventilation configuration; and FIG. 5 shows a schematic longitudinal cross-section of a smoking article according to an eighth embodiment of the invention in the high ventilation configuration.

The smoking articles shown in FIGS. 1 to 5 have several components in common. These components have been given the same reference numerals.

The smoking article 10 according to the first embodiment shown in FIG. 1 is a filter cigarette comprising an elongate cylindrical wrapped tobacco rod 11 attached at one end to an axially aligned, elongate cylindrical mouthpiece 12. The wrapped tobacco rod 11 and the mouthpiece 12 are joined by substantially air impermeable tipping paper, which circumscribes the entire length of the mouthpiece 12 and an adjacent portion of the wrapped tobacco rod 11.

The mouthpiece 12 of the smoking article 10 according to the first embodiment of the invention comprises a plug of cellulose acetate tow or other filtration material circumscribed in a substantially air impermeable filter plug wrap. As shown in FIG. 1, the filter plug is divided into a first downstream segment 14 and a second upstream segment 15 by a circumferentially extending cut 16 which defines a central, axial core 30 about which the first segment 14 can be rotated relative to the second segment 15.

The tipping paper extends from the downstream end of the mouthpiece 12, where it is affixed to the first segment 14 of the mouthpiece by a first band of adhesive 22, to a point on the wrapped tobacco rod 11 adjacent to the mouthpiece 12, where it is also affixed to the second segment of the filter 15 and the wrapped tobacco rod 11 by a second band of adhesive 23.

As shown in FIG. 1, a circumferential line of perforations 17 is provided in the tipping paper at a point between the circumferentially extending cut 16 in the mouthpiece and the wrapped tobacco rod 11. In use, the circumferential line of perforations 17 is broken to divide the tipping paper into a first wrapper 24 and a second wrapper 25.

A first airflow pathway is provided through a portion of the first wrapper 24 overlying the second segment 15 of the mouthpiece 12. As shown in FIG. 1, the first airflow pathway comprises a pair of first openings 18, 19 in the tipping paper.

A second air flow pathway is provided upstream of the first airflow pathway through a portion of the second wrapper 25 overlying the second segment 15 of the mouthpiece 12. As shown in FIG. 1, the second airflow pathway comprises a single second opening 26 in the tipping paper.

A third airflow pathway is provided through a portion of the filter plug wrap overlying the second segment 15. As shown in FIG. 1, the third airflow pathway comprises a pair of third openings 20, 21 in the filter plug wrap.

A fourth airflow pathway is provided upstream of the third airflow pathway through a portion of the filter plug wrap overlying the second segment 15. As shown in FIG. 1, the fourth airflow pathway comprises a single fourth opening 27 in the filter plug wrap.

As shown in FIG. 1, in the high ventilation configuration the pair of first openings 18, 19 of the first airflow pathway provided through the first wrapper 24 is aligned with the pair of third openings 20, 21 of the third airflow pathway provided through the underlying portion of the filter plug wrap overlying the second segment 15.

As also shown in FIG. 1, in the high ventilation configuration the second opening 26 of the second airflow pathway provided through the second wrapper 25 is aligned with the fourth opening 27 of the fourth airflow pathway provided through the underlying portion of the filter plug wrap overlying the second segment 15.

Once the circumferential line of perforations 17 is broken, the first wrapper 24 is free to rotate with the first segment 14 of the mouthpiece 12 about the axis of the central core 30 thereof, such that the pair of first openings 18, 19 of the first airflow pathway provided through the first wrapper 24 and the pair of third openings 20, 21 of the third airflow pathway provided through the underlying portion of the filter plug wrap are in varying degrees of registry. As described further below, adjustment of the degree of registry permits varying amounts of air to enter the mouthpiece 12, thereby varying the air dilution of the mainstream smoke of the smoking article 10.

Smoking articles according to the first embodiment of the invention shown in FIG. 1 may be manufactured by providing a mouthpiece 12 comprising a plug of cellulose acetate tow or other suitable filtration material wrapped in a substantially impermeable filter plug wrap and joining it to a wrapped tobacco rod 11 by overwrapping the mouthpiece 12 and the wrapped tobacco rod 11 with a length of substantially air impermeable tipping paper provided with a line of perforations 17. The tipping paper is bonded by adhesive band 22 to the downstream end of the first segment 14 of the mouthpiece 12 and by adhesive band 23 to the upstream end of the second segment 15 the mouthpiece 12 and to the adjacent downstream end of the wrapped tobacco rod 11.

To form the first air flow pathway and the third airflow pathway, a pair of openings is made through both the portion of the tipping paper downstream of the circumferential line of perforations 17 and the underlying portion of the filter plug wrap overlying the second segment 15 of the mouthpiece 12 by a knife or a laser, or other suitable means, simultaneously forming the pair of first openings 18, 19 and the aligned pair of third openings 20, 21.

To form the second air flow pathway and the fourth airflow pathway, an opening is made through both the portion of the tipping paper upstream of the circumferential line of perforations 17 and the underlying portion of the filter plug wrap overlying the second segment 15 of the mouthpiece 12 by mechanical means, such as a pin, or a laser, or other suitable means, simultaneously forming the second opening 26 and the aligned fourth opening 27.

Suitable means and methods for forming the first air flow pathway and third airflow pathway, and also the second airflow pathway and fourth airflow pathway are known in the art and described in, for example, U.S. Pat. No. 4,570,649.

As manufactured, the pair of first openings 18, 19 of the first airflow pathway are completely in registry with the pair of third openings 20, 21 of the third airflow pathway and the second opening 26 of the second airflow pathway is completely in registry with the fourth opening 27 of the fourth airflow pathway. In this high ventilation configuration, airflow into the mouthpiece through the first airflow pathway is substantially unrestricted and airflow into the mouthpiece through the second airflow pathway is substantially unrestricted providing a maximum level of ventilation.

As the first segment 14 of the mouthpiece 12 is rotated relative to the second segment 15 thereof about the central axial core 30, the pair of first openings 18, 19 of the first airflow pathway provided through the first wrapper 24 and the pair of third openings 20, 21 of the third airflow pathway provided through the underlying portion of the filter plug wrap begin to deregister. After sufficient rotation of the first segment of the mouthpiece 12, the pair of first openings 18, 19 of the first airflow pathway and the pair of third openings 20, 21 of the third airflow pathway are misaligned. In this low ventilation configuration, airflow into the mouthpiece through the first airflow pathway is restricted.

Throughout rotation of the first segment 14, the second opening 26 of the second airflow pathway provided through the second wrapper 25 remains completely in registry with the fourth opening 27 of the fourth airflow pathway provided through the underlying portion of the filter plug wrap. Therefore, in the low ventilation configuration airflow into the mouthpiece through the second airflow pathway and the fourth airflow pathway is substantially unrestricted, providing a minimum or 'baseline' level of ventilation.

A smoking article according to a second embodiment of the invention (not shown) is of largely identical construction to the smoking article according to the first embodiment of the invention shown in FIG. 1. However, in the smoking article according to the second embodiment of the invention the second airflow pathway is provided downstream of the first airflow pathway through a portion of the first wrapper 25 overlying the first segment 14 of the mouthpiece 12 and the fourth airflow pathway is provided downstream of the third airflow pathway through a portion of the filter plug wrap overlying the first segment 14.

The smoking article 30 according to the third embodiment of the invention shown in FIGS. 2*a* and 2*b* is of largely identical construction to the smoking article according to the first embodiment of the invention shown in FIG. 1. However, in the smoking article 30 according to the third embodiment of the invention, the first airflow pathway and the second airflow pathway are both provided through a portion of the first wrapper 24 overlying the second segment 15 and are circumferentially aligned such that the second opening 26 of the second airflow pathway is disposed between the pair of first openings 18, 19 of the first airflow pathway. The third airflow pathway and the fourth airflow pathway are also circumferentially aligned such that the fourth opening 27 of the fourth airflow pathway is disposed between the pair of third openings 20, 21 of the third airflow pathway. As shown in FIGS. 2*a* and 2*b*, the second opening 26 of the second airflow pathway and the fourth opening 27 of the fourth airflow pathway are of reduced size compared to the pair of first openings 18, 19 of the first airflow pathway and the pair of third openings 20, 21 of the third airflow pathway.

In the high ventilation configuration shown in FIG. 2*a* the pair of first openings 18, 19 of the first airflow pathway are aligned with the pair of third openings 20, 21 of the third airflow pathway and the second opening 26 of the second airflow pathway is aligned with the fourth opening 27 of the fourth airflow pathway. In this high ventilation configuration, airflow into the mouthpiece through the first airflow pathway is substantially unrestricted and airflow into the mouthpiece through the second airflow pathway is substantially unrestricted providing a maximum level of ventilation.

As the first segment 14 of the mouthpiece 12 is rotated relative to the second segment 15 thereof about the central axial core 30, the pair of first openings 18, 19 of the first airflow pathway and the pair of third openings 20, 21 of the third airflow pathway begin to deregister and the second opening 26 of the second airflow pathway and the fourth opening 27 of the fourth airflow pathway begin to deregister. As shown in FIG. 2*b*, after rotation of the first segment of the mouthpiece 12 through approximately 90 degrees, one of the pair of first openings 18 of the first airflow pathway is misaligned with both the pair of third openings 20, 21 of the third airflow pathway and the fourth opening 27 of the fourth airflow pathway and the other of the pair of first openings 19 of the first airflow pathway is misaligned with the pair of third openings 20, 21 of the third airflow pathway and aligned with the fourth opening 27 of the fourth airflow pathway. In this low ventilation configuration, airflow into the mouthpiece through the first opening 18 of the first airflow pathway that is misaligned with both the pair of third openings 20, 21 of the third airflow pathway and the fourth opening 27 of the fourth airflow pathway is prevented. In the low ventilation configuration, airflow through the first opening 19 of the first airflow pathway that is misaligned with the pair of third openings 20, 21 of the third airflow pathway and aligned with the fourth opening 27 of the fourth airflow pathway is impeded due to the smaller size of the fourth opening 27 of the fourth airflow pathway compared to the first opening 19 of the first airflow pathway.

In the low ventilation configuration shown in FIG. 2*b* the second opening 26 of the second airflow pathway is aligned with one of the pair of third openings 20 of the third airflow pathway and airflow into the mouthpiece through the second airflow pathway is substantially unrestricted due to the smaller size of the second opening 26 of the second airflow pathway compared to the third opening 20 of the third airflow pathway.

The smoking article 40 according to the fourth embodiment of the invention shown in FIGS. 3*a* and 3*b* is of largely identical construction to the smoking article according to the third embodiment of the invention shown in FIGS. 2*a* and 2*b*. However, in the smoking article 40 according to the fourth embodiment of the invention, the second airflow pathway and the fourth airflow pathway each comprise a group of three adjacent openings in order to increase the minimum level of ventilation in the low ventilation configuration.

Smoking articles according to the first, second and third embodiments of the invention having a first airflow pathway comprising a single slit and a second airflow pathway comprising a circumferential line of perforations were produced. The level of ventilation of a plurality of smoking articles according to each embodiment in the low ventilation configuration was measured in accordance with ISO 9512: 2002. For the purposes of comparison, the level of ventilation of a plurality of smoking articles of identical construction but without a second airflow pathway was also measured in accordance with ISO 9512:2002. The results are shown in Table 1.

TABLE 1

| | Embodiment 1 | Comparison | Embodiment 2 | Comparison | Embodiment 3 | Comparison |
|---|---|---|---|---|---|---|
| Sample size | 187 | 191 | 342 | 383 | 400 | 400 |
| Average level of ventilation in the low ventilation configuration (%) | 31.72 | 21.38 | 22.83 | 17.78 | 36.3 | 10.6 |
| CV (%) | 25.50 | 36.67 | 26.59 | 36.84 | 15.70 | 82.08 |

As illustrated by the coefficients of variation (CV) in Table 1, the minimum or 'baseline' level of ventilation of the smoking articles according to the first, second and third embodiments in the low ventilation configuration is more consistent from smoking article to smoking article than that of the smoking articles of identical construction without a second airflow pathway.

The smoking article 50 according to the fifth embodiment shown in FIG. 4 is a filter cigarette comprising an elongate cylindrical wrapped tobacco rod 11 attached at one end to an axially aligned, elongate cylindrical mouthpiece 12. The wrapped tobacco rod 11 and the mouthpiece 12 are joined by substantially air impermeable tipping paper, which circumscribes the entire length of the mouthpiece 12 and an adjacent portion of the wrapped tobacco rod 11.

The mouthpiece 12 of the smoking article 50 according to the fifth embodiment of the invention comprises a plug of cellulose acetate tow or other filtration material circumscribed in a substantially air impermeable filter plug wrap. As shown in FIG. 4, the filter plug wrap comprises a mouth-end band 52, a central band 54, and a rod-end band 56, defined by two circumferential lines of perforations 58, 60. The mouth-end band 52 and the rod-end band 56 of the filter plug wrap are affixed to the filter plug and the central band 54 of the filter plug wrap is rotatable about the longitudinal axis of the smoking article 50.

A circumferential line of perforations 17 is provided in the tipping paper at a point overlying the rod-end band 56 of the filter plug wrap. In use, the circumferential line of perforations 17 is broken to divide the tipping paper into a first wrapper 24 and a second wrapper 25. As shown in FIG. 4, the first wrapper 24 is affixed to the central band 54 of the filter plug wrap by a first band of adhesive 22 and the second wrapper 25 is affixed to the rod-end band 56 of the filter plug wrap and the wrapped tobacco rod 11 by a second band of adhesive 23.

A first airflow pathway is provided through a portion of the first wrapper 24 overlying the rod-end band 56 of the filter plug wrap. As shown in FIG. 4, the first airflow pathway comprises a pair of first openings 18, 19 in the tipping paper.

A second air flow pathway is provided upstream of the first airflow pathway through a portion of the second wrapper 25 overlying the rod-end band 56 of the filter plug wrap. As shown in FIG. 4, the second air flow pathway comprising a single second opening 26 in the tipping paper.

A third airflow pathway is provided through the rod-end band 56 of the filter plug wrap. As shown in FIG. 4, the third air flow pathway comprises a pair of third openings 20, 21 in the filter plug wrap.

A fourth airflow pathway is provided upstream of the third airflow pathway through the rod-end band 56 of the filter plug wrap. As shown in FIG. 4, the fourth air flow pathway comprising a single fourth opening 27 in the filter plug wrap.

As shown in FIG. 4, in the high ventilation configuration the pair of first openings 18, 19 of the first airflow pathway provided through the first wrapper 24 are aligned with the pair of third openings 20, 21 of the third airflow pathway provided through the underlying rod-end band 56 of the filter plug wrap.

As also shown in FIG. 4, in the high ventilation configuration the second opening 26 of the second airflow pathway provided through the second wrapper 25 is aligned with the fourth opening 27 of the fourth airflow pathway provided through the underlying rod-end band 56 of the filter plug wrap.

Once the circumferential lines of perforations 17, 58, 60 in the tipping paper and the filter plug wrap are broken, the first wrapper 24 is free to rotate with the central band 54 of the filter plug wrap about the longitudinal axis of the smoking article 50, such that the pair of first openings 18, 19 of the first airflow pathway provided through the first wrapper 24 and the pair of third openings 20, 21 of the third airflow pathway provided through the underlying rod-end band 56 of the filter plug wrap are in varying degrees of registry. Adjustment of the degree of registry permits varying amounts of air to enter the mouthpiece 12, thereby varying the air dilution of the mainstream smoke of the smoking article 50.

Smoking articles according to the fifth embodiment of the invention shown in FIG. 4 may be manufactured in substantially the same manner as smoking articles according to the first embodiment of the invention by providing a mouthpiece 12 comprising a plug of cellulose acetate tow or other suitable filtration material wrapped in a pre-perforated substantially impermeable filter plug wrap and joining it to a wrapped tobacco rod 11 by overwrapping the mouthpiece 12 and the wrapped tobacco rod 11 with a length of substantially air impermeable tipping paper provided with a line of perforations 17.

As manufactured, the pair of first openings 18, 19 of the first airflow pathway are completely in registry with the pair of third openings 20, 21 of the third airflow pathway and the second opening 26 of the second airflow pathway is completely in registry with the fourth opening 27 of the fourth airflow pathway. In this high ventilation configuration, airflow into the mouthpiece through the first airflow pathway is substantially unrestricted and airflow into the mouthpiece through the second airflow pathway is substantially unrestricted providing a maximum level of ventilation.

As the first wrapper 24 and the central band 54 of the filter plug wrap are rotated relative to the second wrapper 25 about the longitudinal axis of the smoking article 50, the pair of first openings 18, 19 of the first airflow pathway provided through the first wrapper 24 and the pair of third openings 20, 21 of the third airflow pathway provided through the underlying rod-end band 56 of the filter plug wrap begin to deregister. After sufficient rotation of the first wrapper 24, the first openings 18, 19 of the first airflow pathway and the third openings 20, 21 of the third airflow pathway are misaligned. In this low ventilation configuration, airflow into the mouthpiece through the first airflow pathway is restricted.

Throughout rotation of the first wrapper 24, the second opening 26 of the second airflow pathway provided through the second wrapper 25 remains completely in registry with the fourth opening 27 of the fourth airflow pathway provided through the underlying rod-end band 56 of the filter plug wrap. Therefore, in the low ventilation configuration airflow into the mouthpiece through the second airflow pathway is substantially unrestricted, providing a minimum or 'base-line' level of ventilation.

A smoking article according to a sixth embodiment of the invention (not shown) is of largely identical construction to the smoking article according to the fifth embodiment of the invention shown in FIG. 4. However, in the smoking article according to the sixth embodiment of the invention the second airflow pathway is provided downstream of the first airflow pathway through a portion of the first wrapper 24 overlying the central band 54 of the filter plug wrap and the fourth airflow pathway is provided downstream of the third airflow pathway through the central band of the filter plug wrap.

A smoking article according to a seventh embodiment of the invention (not shown) is also of largely identical construction to the smoking article according to the fifth embodiment of the invention shown in FIG. 4. However, in the smoking article according to the seventh embodiment of the invention, the first airflow pathway and the second airflow pathway are both provided through a portion of the first wrapper 24 overlying the rod-end band 56 of the filter plug wrap and are circumferentially aligned such that the second opening 26 of the second airflow pathway is disposed between the pair of first openings 18, 19 of the first airflow pathway as in the third and fourth embodiments of the invention shown in FIGS. 2 and 3. In the smoking article according to the seventh embodiment of the invention, the third airflow pathway and the fourth airflow pathway are both provided through the rod-end band 56 of the filter plug wrap and are also circumferentially aligned such that the fourth opening 27 of the fourth airflow pathway is disposed between the pair of third openings 20, 21 of the third airflow pathway as in the third and fourth embodiments of the invention shown in FIGS. 2 and 3.

The smoking article 70 according to the eighth embodiment shown in FIG. 5 is a filter cigarette comprising an elongate cylindrical wrapped tobacco rod 11 attached at one end to an axially aligned, elongate cylindrical mouthpiece 12.

The mouthpiece 12 of the smoking article 70 according to the eighth embodiment of the invention is a multi-segment mouthpiece comprising a first upstream segment 14 and a second downstream segment 15. The first segment 14 and the second segment 15 each comprise a plug of cellulose acetate tow or other filtration material circumscribed in a substantially air impermeable filter plug wrap.

The wrapped tobacco rod 11 and the mouthpiece 12 are joined by a first wrapper 24 of substantially air impermeable tipping paper, which circumscribes the first segment 14 of the mouthpiece 12 and an adjacent portion of the wrapped tobacco rod 11. The first wrapper 24 is affixed to the first segment 14 of the mouthpiece 12 and the wrapped tobacco rod 11 by a band of adhesive (not shown).

As shown in FIG. 5, a second wrapper 25 of substantially air impermeable tipping paper circumscribes the second segment 15 of the mouthpiece 12 and the first segment 14 of the mouthpiece 12, such that the second wrapper 25 overlies the first wrapper 24. The second wrapper 25 is affixed to the second segment 15 by a band of adhesive (not shown).

A first airflow pathway is provided through the first wrapper 24 overlying the first segment 14 of the mouthpiece 12. As shown in FIG. 5, the first airflow pathway comprises a pair of first openings 18, 19 in the first wrapper 24.

A second air flow pathway is provided through the second wrapper 25 overlying the second segment 15 of the mouthpiece 12. As shown in FIG. 5, the second air flow pathway comprises a single second opening 26 in the second wrapper 25.

A third airflow pathway is provided through the filter plug wrap circumscribing the first segment 14 of the mouthpiece 12. As shown in FIG. 5, the third airflow pathway comprises a pair of third openings 20, 21 in the filter plug wrap.

A fourth airflow pathway is provided through the filter plug wrap circumscribing the second segment 15 of the mouthpiece 12. As shown in FIG. 5, the fourth air flow pathway comprises a single fourth opening 27 in the filter plug wrap.

The pair of first openings 18, 19 of the first airflow pathway provided through the first wrapper 24 are aligned with the pair of third openings 20, 21 of the third airflow pathway provided through the underlying filter plug wrap circumscribing the first segment 14 of the mouthpiece 12 and the second opening 26 of the second airflow pathway provided through the second wrapper 25 is aligned with the fourth opening 27 of the fourth airflow pathway provided through the underlying filter plug wrap circumscribing the second segment 15 of the mouthpiece 12.

The second segment 15 is movable along the longitudinal axis of the smoking article relative to the first segment 14 between a low ventilation configuration (not shown) in which the second segment 15 of the mouthpiece 12 abuts the first segment 14 thereof and the high ventilation configuration shown in FIG. 5 in which the second segment 15 of the mouthpiece 12 is longitudinally spaced apart from the first segment 14 thereof. In the high ventilation configuration shown in FIG. 5, the length of the smoking article 70 according to the eighth embodiment of the invention is greater than in the low ventilation configuration.

The first wrapper 24 and the second wrapper 25 comprise retention means that cooperate in the high ventilation configuration to prevent the second segment 15 of the mouthpiece being removed from the smoking article 70. The retention means 72 on the first wrapper 24 is formed by folding the downstream end of the tipping paper towards the exterior of the smoking article 70 and the retention means 74 on the second wrapper 25 is formed by folding the upstream end of the tipping paper towards the interior of the smoking article 70. As shown in FIG. 5, the retention means 72 of the first wrapper and the retention means 74 of the second wrapper are arranged such that the folded ends of tipping paper engage one another when the smoking article 70 is in high ventilation configuration.

In the high ventilation configuration, the first openings 18, 19 of the first airflow pathway provided through the first wrapper 14 are exposed and the second opening 26 of the second airflow pathway provided through the second wrapper 15 is exposed. Thus in the high ventilation configuration, airflow into the mouthpiece through the first airflow pathway is substantially unrestricted and airflow into the mouthpiece through the second airflow pathway is substantially unrestricted providing a maximum level of ventilation.

In the low ventilation configuration, the second wrapper 25 overlies and covers the first openings 18, 19 of the first airflow pathway provided through the first wrapper 14. Thus in the high ventilation configuration, airflow into the mouthpiece 12 through the first airflow pathway is restricted. However, in the low ventilation configuration the second opening 26 of the second airflow pathway provided through the second wrapper 25 remains exposed. Therefore, in the low ventilation configuration airflow into the mouthpiece through the second airflow pathway is substantially unrestricted, providing a minimum or 'baseline' level of ventilation.

A smoking article according to a ninth embodiment of the invention (not shown) is of largely identical construction to the smoking article according to the eighth embodiment of the invention shown in FIG. 5. However, in the smoking article according to the ninth embodiment of the invention the second airflow pathway is provided upstream of the first airflow pathway through a portion of the first wrapper 24 that is not covered by the second wrapper 25 in the low ventilation configuration and the fourth airflow pathway is provided upstream of the third airflow pathway through the filter plug wrap circumscribing the first segment 14 of the mouthpiece.

The invention claimed is:

1. A smoking article comprising a mouthpiece circumscribed by a first wrapper and a second wrapper, wherein the first wrapper and the second wrapper are substantially air impermeable and are rotatable relative to one another about the longitudinal axis of the smoking article between a low ventilation configuration and a high ventilation configuration, wherein the first wrapper and the second wrapper abut one another in both the low ventilation configuration and the high ventilation configuration; wherein the mouthpiece comprises a first airflow pathway through the first wrapper or the second wrapper and a second airflow pathway through the first wrapper or the second wrapper, wherein in the low ventilation configuration airflow into the mouthpiece through the first airflow pathway is restricted and airflow into the mouthpiece through the second airflow pathway is substantially unrestricted and wherein in the high ventilation configuration airflow into the mouthpiece through the first airflow pathway and the second airflow pathway is substantially unrestricted, at least a minimum level of ventilation being provided by airflow into the mouthpiece through one or both of the first airflow pathway and the second airflow pathway during rotation of the first wrapper and the second wrapper relative to one another between the low ventilation configuration and the high ventilation configuration.

2. A smoking article according to claim 1 wherein the level of ventilation provided by airflow into the mouthpiece through the first airflow pathway and the second airflow pathway during movement of the first wrapper and the second wrapper relative to one another between the low ventilation configuration and the high ventilation configuration is greater than or equal to the level of ventilation provided by airflow through the first airflow pathway and the second airflow pathway in the low ventilation configuration.

3. A smoking article according to claim 2 wherein the first airflow pathway is provided through the first wrapper and the second airflow pathway is provided through the second wrapper.

4. A smoking article according to claim 3 wherein the second airflow pathway is upstream of the first airflow pathway.

5. A smoking article according to claim 3 wherein the second airflow pathway is downstream of the first airflow pathway.

6. A smoking article according to claim 2 wherein the first airflow pathway and the second airflow pathway are provided through the first wrapper.

7. A smoking article according to claim 6 wherein the second airflow pathway is upstream of the first airflow pathway.

8. A smoking article according to claim 1 wherein the first airflow pathway is provided through the first wrapper and the second airflow pathway is provided through the second wrapper.

9. A smoking article according to claim 1 wherein the first airflow pathway and the second airflow pathway are provided through the first wrapper.

10. A smoking article according to claim 9 wherein the first airflow pathway and the second airflow pathway are circumferentially aligned.

11. A smoking article according to claim 1 wherein the second airflow pathway is upstream of the first airflow pathway.

12. A smoking article according to claim 1 wherein the second airflow pathway is downstream of the first airflow pathway.

13. A smoking article according to claim 1 wherein the mouthpiece further comprises a third airflow pathway, wherein in the low ventilation configuration the first airflow pathway and the third airflow pathway are substantially misaligned and airflow into the mouthpiece through the first airflow pathway is restricted and wherein in the high ventilation configuration the first airflow pathway and the third airflow pathway are substantially aligned and airflow into the mouthpiece through the first airflow pathway is substantially unrestricted.

14. A smoking article according to claim 13 wherein the mouthpiece further comprises a fourth airflow pathway, wherein in the low ventilation configuration and the high ventilation configuration the second airflow pathway and the fourth airflow pathway are substantially aligned and airflow into the mouthpiece through the second airflow pathway is substantially unrestricted.

15. A smoking article according to claim 13 wherein the mouthpiece further comprises a fourth airflow pathway, wherein in the low ventilation configuration the second airflow pathway and the fourth airflow pathway are substantially aligned and airflow into the mouthpiece through the second airflow pathway is substantially unrestricted and wherein in the high ventilation configuration the second airflow pathway and the third airflow pathway are substantially aligned and airflow into the mouthpiece through the second airflow pathway is substantially unrestricted.

16. A smoking article according to claim 1 comprising a stop configured to restrict movement of the first wrapper and the second wrapper relative to one another.

17. A smoking article according to claim 1 further comprising an indicator configured to indicate the level of ventilation.

* * * * *